US009896325B2

(12) United States Patent
Keith et al.

(10) Patent No.: US 9,896,325 B2
(45) Date of Patent: Feb. 20, 2018

(54) VACUUM VAPOR LIQUID RECOVERY SYSTEM

(71) Applicants: Gary Keith, Protland, OR (US); Shannon Keith, League City, TX (US)

(72) Inventors: Gary Keith, Protland, OR (US); Shannon Keith, League City, TX (US)

( * ) Notice: Subject to any disclaimer, the term of this patent is extended or adjusted under 35 U.S.C. 154(b) by 293 days.

(21) Appl. No.: 14/939,051

(22) Filed: Nov. 12, 2015

(65) Prior Publication Data

US 2016/0199771 A1 Jul. 14, 2016

Related U.S. Application Data

(60) Provisional application No. 62/102,572, filed on Jan. 12, 2015.

(51) Int. Cl.
*B67D 7/04* (2010.01)
*B67D 7/84* (2010.01)
*C10G 5/06* (2006.01)

(52) U.S. Cl.
CPC ..... *B67D 7/0492* (2013.01); *B67D 7/0476* (2013.01); *C10G 5/06* (2013.01); *B67D 7/845* (2013.01)

(58) Field of Classification Search
CPC .... B67D 7/0476; B67D 7/0492; B67D 7/845; B01D 53/053
See application file for complete search history.

(56) References Cited

U.S. PATENT DOCUMENTS

| | | | | |
|---|---|---|---|---|
| 5,878,767 | A * | 3/1999 | Etling | B67D 7/0476 137/15.01 |
| 6,036,446 | A * | 3/2000 | Goodman | F01M 11/045 137/15.05 |
| 6,786,700 | B2 * | 9/2004 | Taylor | F04F 5/02 417/151 |
| 9,376,011 | B1 * | 6/2016 | Padfield | B60K 15/04 |
| 2009/0007983 | A1 * | 1/2009 | Healy | B67D 7/0476 141/7 |

* cited by examiner

*Primary Examiner* — Ryan A Reis

(57) ABSTRACT

A vacuum vapor liquid recovery system employs a strong vacuum vessel that can withstand vacuums without damage. The vacuum vessel may be portable and configured to accept an inflow drain line for receiving waste liquid/vapors from a processing system. Additionally, at least one outflow drain line is attached to the vacuum vessel to which a vacuum truck or other similar recovery equipment can be connected in order to pump out whatever liquids/vapors have been drained into the vacuum vapor liquid recovery system. Additional features can include wheels to assist in moving and positioning the vacuum vapor liquid recovery system, tow bar, transport handles, support legs, sight port, a wash out connector, a vacuum relief, etc.

20 Claims, 5 Drawing Sheets

VACUUM VAPOR LIQUID RECOVERY SYSTEM

CROSS-REFERENCE TO RELATED APPLICATIONS

This application claims the benefit of U.S. Provisional Application No. 61/931,824 entitled VACUUM VAPOR LIQUID RECOVER SYSTEM and filed on Jan. 12, 2015, which is specifically incorporated by reference herein for all that it discloses and teaches.

TECHNICAL FIELD

The present invention relates generally to the field of hydrocarbon and fuels production; more specifically, to the field of maintaining and cleaning equipment and systems for processing hydrocarbons and fuels; and more particularly still, to a vacuum vapor liquid recovery system.

BACKGROUND

Large industrial complexes are utilized to process raw hydrocarbons in order to produce the fuels and related materials that our complex economy relies upon to move goods, run factories, heat homes, transport food, keep machinery operating smoothly, and otherwise allow our modern lives to continue. In particular, oil and gas plants/refineries are often large, complex facilities with huge storage and processing tanks, miles of pipelines, and untold numbers of towers, valves, pipes, and related equipment that make up the systems. Many of these structures must be periodically drained, cleaned and maintained.

Currently, low-points in such systems often contain drain valves which can be opened to flush out residue liquids, vapors, etc. (collectively, "refuse") that remain after the primary materials have been removed from the system(s). Catch basins, tubs, open-air tanks, etc. are often placed under such drain valves in order to catch some portion of this refuse and a vacuum truck is then used to suck up what materials flow into these basins. However, since much of the refuse is gaseous vapor or volatile liquids, the vacuum truck is left only what liquids haven't evaporated into the environment. Hooking the vacuum truck directly to the system is often impossible; and, when possible, it can be unwise to do so, as the vacuum the truck employs can damage the sometimes fragile equipment in the systems.

What is needed is a piece of portable equipment that can be easily relocated between drain sites and allows for the capture of both liquids and gases/vapors directly from the systems. Such a device should be capable of containing both liquids and vapors, must be able to withstand the vacuum from the vacuum truck, and should have safety valve(s) to release and handle varying vacuums so that the system that is being drained is protected therefrom.

SUMMARY

A vacuum vapor liquid recovery system employs a strong vacuum vessel or tank that can withstand vacuums without damage. The vacuum vessel may be portable and configured to accept a plurality of inflow drain lines for receiving waste liquid/vapors from a processing system. Additionally, at least one primary outflow drain line is attached to the vacuum vessel to which a vacuum truck or other similar recovery equipment can be connected in order to pump out whatever liquids/vapors have been drained into the vacuum vapor liquid recovery system. Additional features can include wheels to assist in moving and positioning the vacuum vapor liquid recovery system, tow bar, transport handles, support legs, sight port, a wash out connector, a vacuum relief, etc.

DETAILED DESCRIPTION

Figure 1:
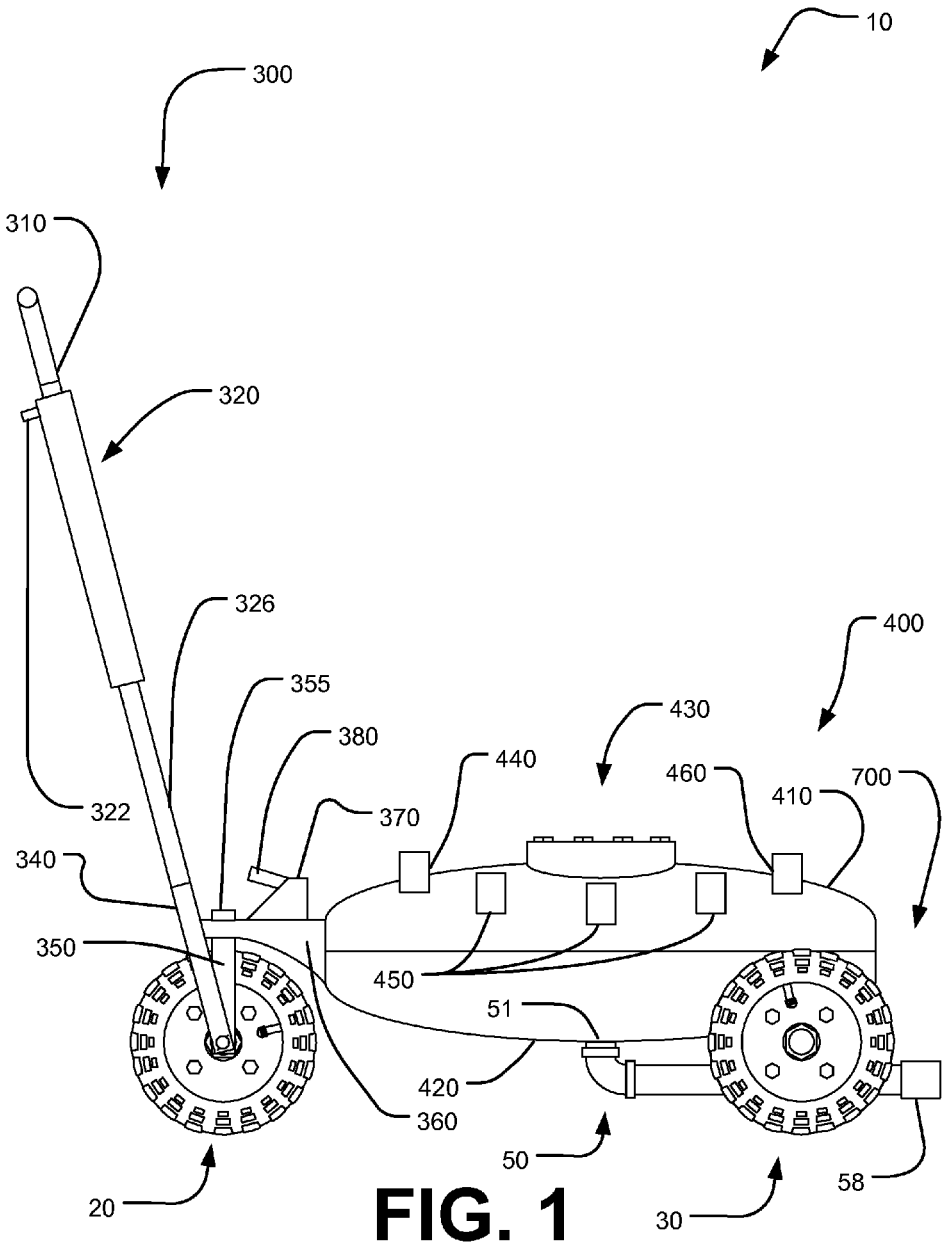
FIG. 1 illustrates a left side elevation view of an exemplary embodiment of a vacuum vapor liquid recovery system.

In the following discussion, numerous specific details are set forth to provide a thorough understanding of the present disclosure. However, those skilled in the art will appreciate that embodiments may be practiced without such specific details. Furthermore, lists and/or examples are often provided and should be interpreted as exemplary only and in no way limiting embodiments to only those examples. Similarly, in this disclosure, language such as "could, should, may, might, must, have to, can, would, need to, is, is not", etc. and all such similar language shall be considered interchangeable whenever possible such that the scope of the invention is not unduly limited. For example, a comment such as: "item X is used" can be interpreted to read "item X can be used".

Exemplary embodiments are described below in the accompanying Figures. The following detailed description provides a comprehensive review of the drawing Figures in order to provide a thorough understanding of, and an enabling description for, these embodiments. One having ordinary skill in the art will understand that in some cases well-known structures and functions have not been shown or described in detail to avoid unnecessarily obscuring the description of the embodiments.

Referring now to the drawings, FIG. 1 illustrates a left side elevation view of an exemplary embodiment of a vacuum vapor liquid recovery system 10. The primary components illustrated in FIG. 1 include a vacuum vessel device 400, a vacuum vessel top portion 410, a vacuum vessel bottom portion 420, a sight port 430, a vacuum relief valve 440, a plurality of inflow drain line ports 450, a washout connector 460, at least one primary outflow drain line 50, a front wheel 20, a plurality of rear wheels 30, and a frontal support and repositioning structure 300.

In the embodiment illustrated in FIG. 1, the vacuum vessel device 400 is shown comprising a vacuum vessel top portion 410 and a vacuum vessel bottom portion 420. In another embodiment, the vacuum vessel device 400 could be constructed as a single component. In yet another embodiment, the vacuum vessel device 400 could be constructed from multiple sub-components. In any case, the vacuum vessel device 400 is adapted to receive inflowing vapors/liquids and store them until they are drained away via the outflow drain line 50. The vacuum vessel device 400 can be constructed from any sufficiently strong material that can withstand the various pressures associated with having a vacuum applied thereto as well as the sometimes volatile, caustic, and otherwise reactive properties of the gases/liquids to be held therein. In one embodiment, stainless steel is used to form a curved tank having a low point to which any liquids held therein would naturally flow due to gravity.

The vacuum vessel device 400 comprises a plurality of inflow drain line ports 450 that are attached to the vacuum vessel device 400. In one embodiment, at least one of the plurality of inflow drain line ports 450 extends upwards from a top surface of the vacuum vessel device 400. The plurality of inflow drain line ports 450 are adapted to releasably attach to incoming drain lines so as to receive therethrough the last remaining liquids/vapors from a system.

An outflow drain line 50 can be attached at the low point 51 on the vacuum vessel device 400. The outflow drain line 50 has a plurality of attachments 58 that allow it to be connected to a vacuum truck or similar gas/vapor pumping device. In one embodiment the outflow drain line 50 extends outwards and slightly downwards from the vacuum vessel device 400 so that no pooling locations are created therein. In another embodiment one or more additional outflow drain lines 50 are incorporated into the vacuum vapor liquid recovery system.

A sight port 430 can be incorporated into the vacuum vessel device 400. The sight port 430 provides a means for a person to visually inspect the interior of the vacuum vessel device 400. There are many reasons why this can be desirable, including: determining if anything is entering the vacuum vessel device 400, determining if materials are exiting, determining the amount of materials in the vacuum vessel device 400, etc. The sight port 430 can be built with glass, plastic, or any other suitably strong and sufficiently transparent material(s).

A vacuum relief valve 440 can also be attached to the vacuum vessel device 400. The vacuum relief valve 440 can serve to automatically relieve a vacuum at a certain level (or maintain it at that level), say at three inches of mercury, for example. In other embodiments other levels of vacuum relief valves 440 are contemplated. In yet another embodiment, a user-selectable, variable-setting vacuum relief valve 440 can be employed.

In the embodiment shown in FIG. 1, the vacuum relief valve 440 can be a valve that is opened and closed by a ball with a spring. When no vacuum is present, the spring keeps the ball tightly against the seal, effectively closing the valve. However, when a sufficiently strong vacuum is applied, the ball is pushed away from the seal, the spring is actuated and outside air flows through the valve and into the system 10. In another embodiment, a ball check valve can be used. A ball check valve can be placed in an open position to allow forward flow and in a closed position to block reverse flow. A ball check valve is a check valve in which the closing member, the movable part to block the flow, can be a spherical ball. In some ball check valves, the ball is spring-loaded to help keep it shut. For those designs without a spring, reverse flow is used to move the ball toward the seat and create a seal. The interior surface of the main seats of ball check valves are more or less conically-tapered to guide the ball into the seat and form a positive seal when stopping reverse flow.

In the embodiment shown in FIG. 1, a washout connector 460 is incorporated into the vacuum vessel device 400. The washout connector 460 is adapted to provide for the attachment of a washout device to the vacuum vessel device 400. The washout device can spray water, chemicals, cleaners, air, etc. into the vacuum vessel device 400 in order to washout or clean the interior thereof.

The vacuum vapor liquid recovery system 10 illustrated in FIG. 1 includes a front wheel 20 and a plurality of rear wheels 30. The front wheel is mounted within a frontal support and repositioning structure 300 in the embodiment shown in FIG. 1. In another embodiment, the front wheel 20 may be replaced by one or more support legs (see FIGS. 3A and 3B). In yet another embodiment, the front wheel 20 may comprise two or more front wheels. One or more transport handles can be attached to the vacuum vessel device.

The frontal support and repositioning structure 300 illustrated in FIG. 1 comprises a set of components which allows a user to move and position the vacuum vapor liquid recover system 10 and which supports the vacuum vessel device 400 in a usable orientation. The pull handle 310 attaches to the distal end of the handle collar 320. A handle stand 322 can extend from the handle collar 320, the stand 322 can be adapted to hold the handle off of the ground when the pull handle 310 is set down by the user of the system. This allows the pull handle 310 to be easily and quickly grasped when needed rather than attempting to retrieve it from the dirt, mud, or other debris. In another embodiment, a simple transport handle is used in place of the handle collar, handle stand and pull handle.

Extending from the proximal end of the handle collar is a handle neck 326. The handle neck 326 extends to the wheel fork 340 which surrounds the front wheel 20 and attaches the handle components to the wheel 20. In an alternate embodiment, the wheel fork 340 utilizes a single arm on one side of the wheel 20 rather than the more common two-arm fork extending on either side of the wheel 20. In another embodiment the handle neck, handle collar, handle stand, etc. can be replaced by a simple handle attached to the wheel fork 340.

The wheel fork 340 attaches to an axle of the front wheel 20, allowing the wheel to roll freely as needed and yet provide the user with the leverage to rotate the orientation of the front wheel 20 via the mounting member 350. The mounting member 350 can similarly comprise a one or two arm fork which rotatably mounts the front wheel 20 to the mounting support 360. The mounting member 350 is free to rotate within the mounting support 360 such that the front wheel can be oriented in any direction as desired by the user. A lock cap 355 secures the mounting member 350 to the mounting support 360.

The mounting support 360 is attached to a front portion of the vacuum vessel device 400. The mounting support 360 supports the front of the vacuum vessel device 400 and keeps it oriented correctly such that the low point 51 of the vacuum vessel device 400 remains the low point as the system 10 is repositioned. A handle rest support 370 can be attached to the mounting support 360. The handle rest support 370 provides a structure against which the handle can be rested when not in use. The handle rest support 370 can also incorporate a handle retention device 380 which can comprise a simple flexible grasping clamp which receives within it the handle and securely holds it in place until swung out therefrom by the user. Other types of handle retention means can be utilized in the handle retention device 380, including magnets, springs, etc.

The rear support and repositioning structure 700 illustrated in FIG. 1 comprises a set of components which allows a user to move and position the vacuum vapor liquid recover system 10 and which supports the vacuum vessel device 400 in a usable orientation. In FIG. 1, the only component of a rear support and repositioning structure 700 that is visible is the rear wheel 30. See FIG. 2 for an embodiment with two rear wheels 30 and 35. In other embodiments, the rear support and repositioning structure 700 can comprise one or more transport handles (see FIG. 3A, transport handle 495) and one or more wheels 30. In yet another embodiment, the rear support and repositioning structure 700 can comprise a plurality of transport handles 495 and a plurality of support legs 27 (see FIG. 3A).

The pull handle 310 attaches to the distal end of the handle collar 320. A handle stand 322 can extend from the handle collar 320, the stand 322 can be adapted to hold the handle off of the ground when the pull handle 310 is set down by the user of the system. This allows the pull handle 310 to be easily and quickly grasped when needed rather than attempting to retrieve it from the dirt, mud, or other debris. In another embodiment, a simple handle is used in place of the handle collar, handle stand and pull handle.

In order to employ the vacuum vapor liquid recovery system 10, a user manipulates the frontal support and repositioning structure 300 in order to reposition the system 10 in proximity to one or more drain pipes. The user then attaches one or more drain hoses to the plurality of inflow drain line ports 450 on the system 10 and opens the valves to let material flow down the drain hoses and into the system 10. A vacuum truck or similar recovery equipment can be connected to the plurality of attachments 58 on the outflow drain line 50 in order to induce a vacuum within the system 10 and assist the flow of materials down the drain hoses and into the system 10. Once the drain pipes are emptied, the valves on the drain hoses/pipes can be closed, the drain hoses can be disconnected from the plurality of inflow drain line ports 450 and the vacuum vessel device 400 can be completely emptied into the vacuum truck. The user then again manipulates the frontal support and repositioning structure 300 in order to reposition the system 10 into storage or into position for its next use.

Figure 2:
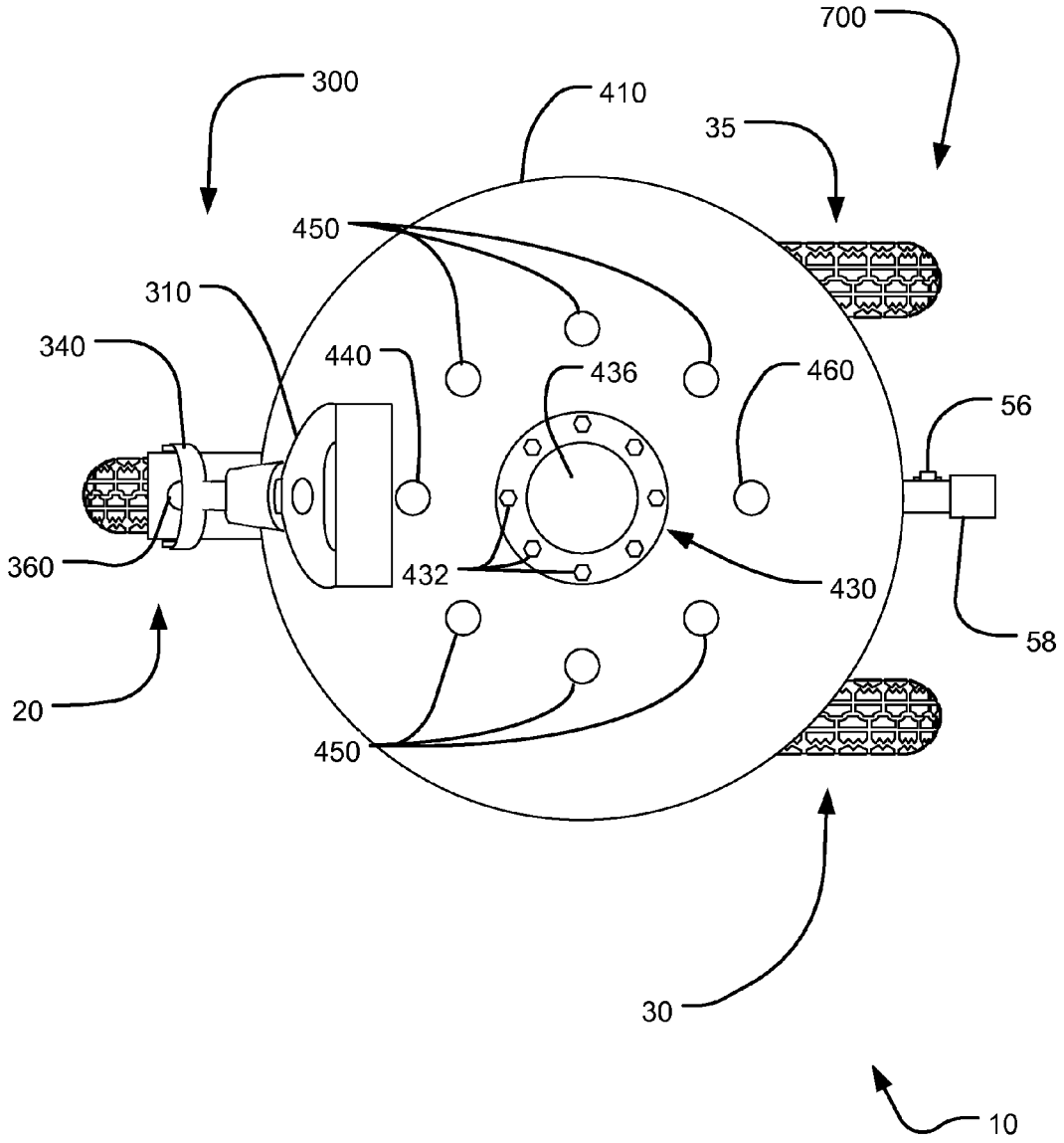
FIG. 2 illustrates a top plan view of an exemplary embodiment of a vacuum vapor liquid recovery system.

FIG. 2 illustrates a top plan view of an exemplary embodiment of a vacuum vapor liquid recovery system 10. The vacuum vessel device 400 is illustrated as are the components of one embodiment of the frontal support and repositioning structure 300 and the rear wheels 30 and 35.

The sight port 430 is seen from above such that the viewing port 436 itself is visible. The viewing port 436 comprises the glass, plastic or similarly transparent material which allows the user to view the interior of the vacuum vessel device 400 and any contents therein. Since the viewing port 436 can be transparent, the interior cavity inside the vacuum vessel device 400 is visible. In other embodiments, non-transparent viewing ports 436 are contemplated, including translucent and opaque. Surrounding the viewing port 436 is a plurality of port attachment means 432. in the embodiment illustrated in FIG. 2, the port attachment means 432 comprise a plurality of bolts that secure the sight port 430 to the vacuum vessel device 400.

A portion of the outflow drain line 50 is shown extending from the rear of the system 10. The plurality of attachments 58 is illustrated as is the shut-off valve 56. As discussed above, the plurality of attachments 58 is adapted to allow the system 10 to be connected to a vacuum truck or other gas/vapor pumping/recovery devices. The shut-off valve 56 can be extremely useful as way to maintain a vacuum or partial vacuum within the system 10 as well as to ensure no liquids/vapors escape the system when not attached to the vacuum truck. Additionally, the shut-off valve 56 helps to ensure foreign bodies (rodents, insects, etc.) can not enter the system 10 unexpectedly.

Figure 3A:
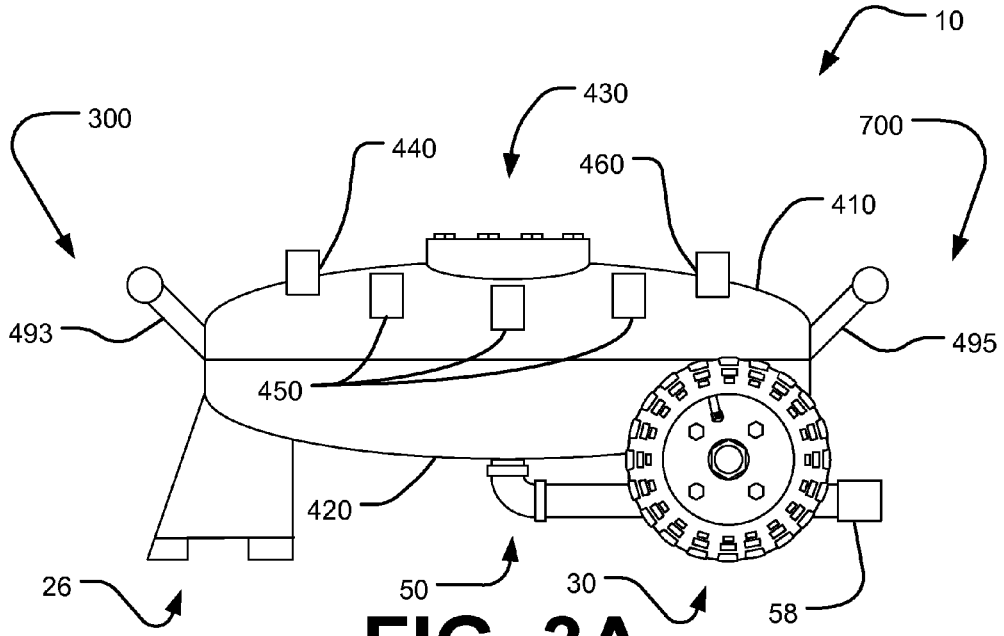
FIG. 3A illustrates a left side elevation view of another exemplary embodiment of a vacuum vapor liquid recovery system utilizing transport handles and support legs.

FIG. 3A illustrates a left side elevation view of another exemplary embodiment of a vacuum vapor liquid recovery system 10 utilizing transport handles 493 and 495 and support legs 26. The transport handles 493 and 495 can replace (as shown in FIG. 3A) or supplement the frontal support and repositioning structure 300 (see FIGS. 1 and 2). Although only one support leg 26 is visible in FIG. 3A, one or more additional support legs can be added to help maintain the stability of the vacuum vessel device 400. Depending on the overall size of the vacuum vapor liquid recovery system 10, one, two, or more people may be required in order to lift and reposition the system 10 using the transport handles 493 and 495. Additionally, for particularly large and/or heavy embodiments of the system 10, the transport handles 493 and 495 can be adapted such that a forklift, tractor, or other equipment can grasp the handles and lift/reposition the system 10.

Figure 3B:
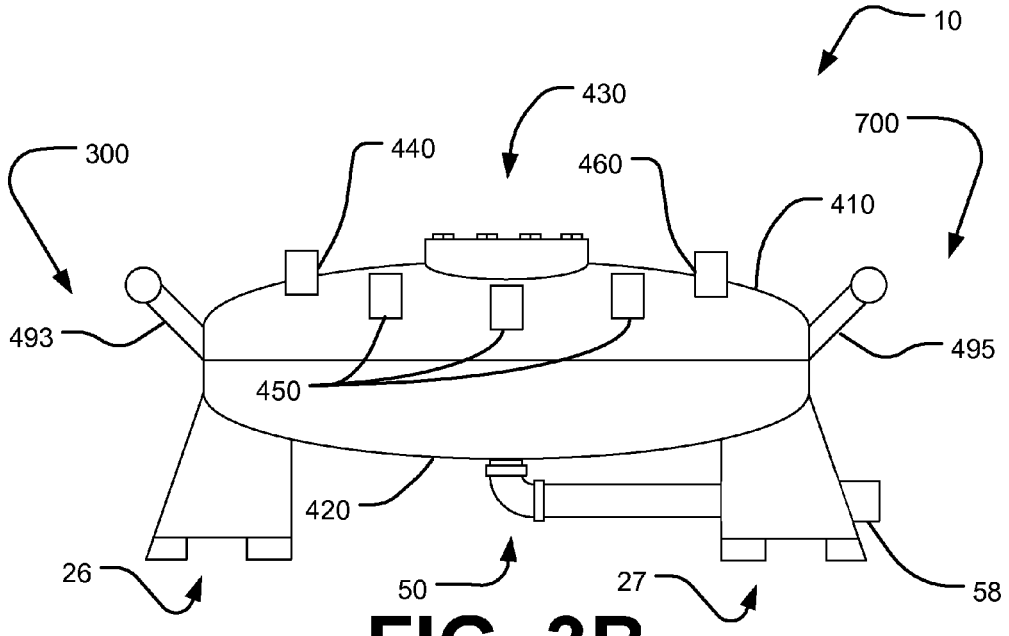
FIG. 3B illustrates a left side elevation view of yet another exemplary embodiment of a vacuum vapor liquid recovery system utilizing transport handles and support legs.

FIG. 3B illustrates a left side elevation view of yet another exemplary embodiment of a vacuum vapor liquid recovery system 10 utilizing transport handles 493 and 495 and support legs 26 and 27. In the view illustrated in FIG. 3B, support legs 26 and 27 have replaced the front and rear wheels of the embodiments illustrated in FIGS. 1 and 2. Although only two support legs 26 and 27 are visible in FIG. 3B, additional support legs can be utilized in order to ensure the vacuum vessel device 400 is fully supported.

Figure 4:
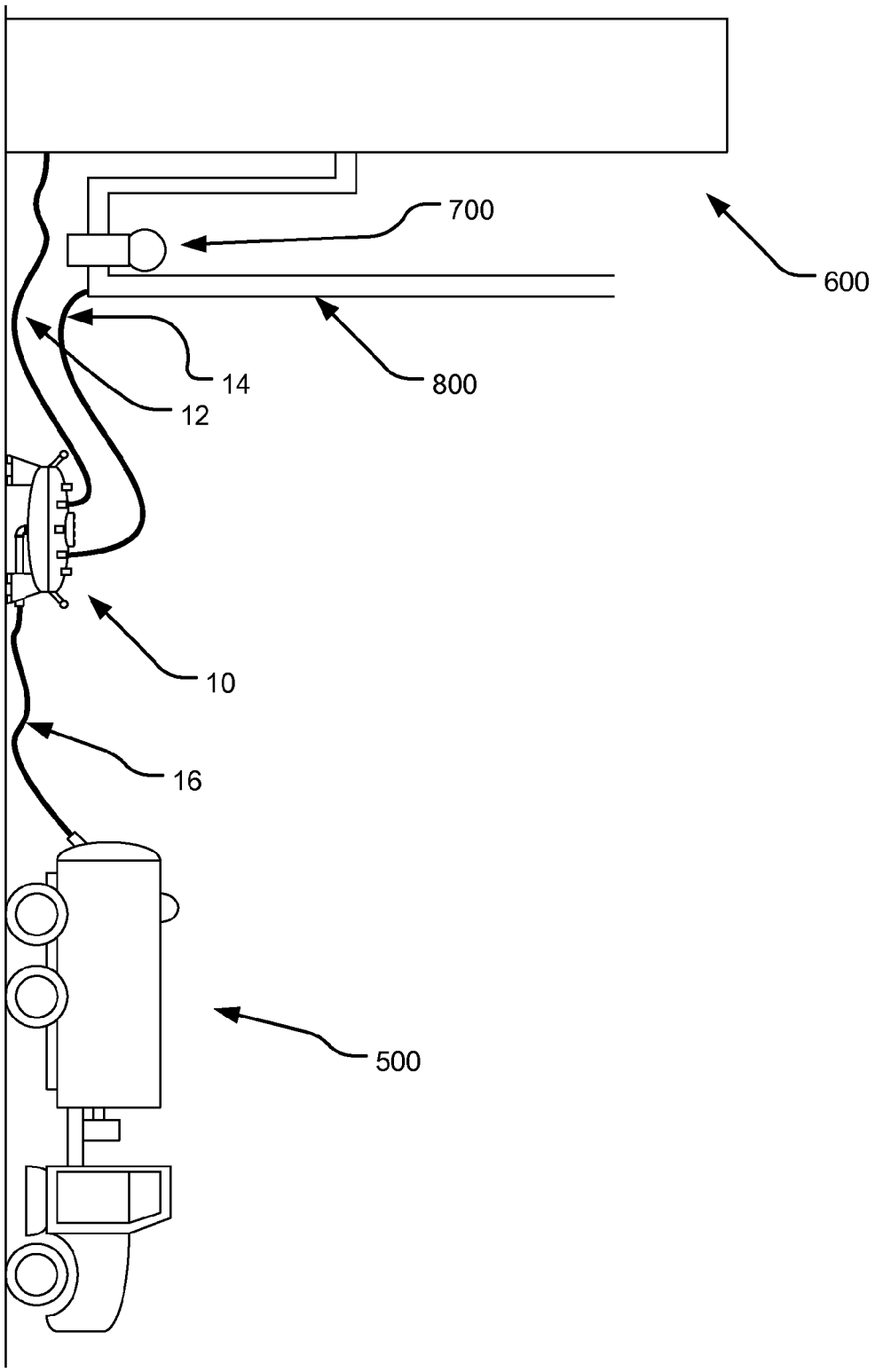
FIG. 4 illustrates a side elevation view of an exemplary embodiment of a vacuum vapor liquid recovery system placed in an environment in which it could be employed.

FIG. 4 illustrates a side elevation view of an exemplary embodiment of a vacuum vapor liquid recovery system 10 placed in an environment in which it could be employed. Here, a process tower 600 is shown with a process tower drain hose 12 connected thereto. The drain hose 12 is connected to one of the plurality of inflow drain line ports 450 on the system 10. A second drain hose 14 is illustrated as being connected to the system 10 and also to a low point drain for process piping 800 near the pump 700. The vacuum truck 500 is illustrated as being attached to the outflow drain line 50 of the system 10 via an outflow drain hose 16. When the vacuum truck 500 is activated, it draws a vacuum in the outflow drain line 50 and when the shut-off valve 56 (not visible in FIG. 4, see FIG. 2) is opened on the drain line 50, the vacuum extends into the vacuum vessel device 400. Each of the plurality of inflow drain line ports 450 can also incorporate its own shut-off valve, but assuming they do not, any vacuum extending into the vacuum vessel device 400 would then automatically extend into the drain hoses 12 and 14. Any materials/vapors/liquids existing in the process tower 600 and process piping 800 should drain through the drain hoses 12 and 14, into the system 10, and then into the vacuum truck 500. If the vacuum truck exerts too large of a vacuum, then the vacuum relief valve 440 in the system 10 would activate to protect the drain hoses, process tower, process piping, pump, etc. from excess vacuum. In this way, the materials are drained from the tower, piping, etc. without evaporating or otherwise escaping into the environment as would otherwise happen when simple catch basins are employed under the drains as is done in the prior art.

Figure 5:
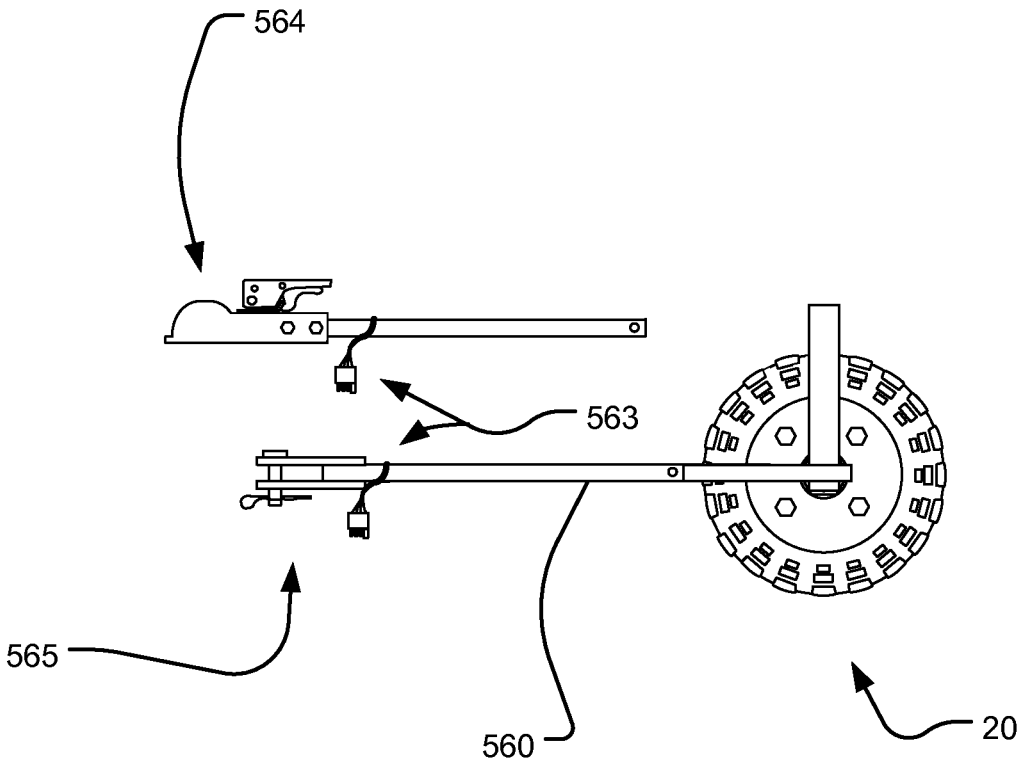
FIG. 5 illustrates a left side elevation view of two exemplary tow bar devices which can be employed in the system to facilitate the powered relocation of the vacuum vapor liquid recovery system.

FIG. 5 illustrates a left side elevation view of two exemplary tow bar devices which can be employed in the system to facilitate the powered relocation of the vacuum vapor liquid recovery system 10. This view depicts a portion of the front wheel assembly 20, and a plurality of hitch assemblies 564 and 565.

A proximal end of the tow bar 560 attaches to the front wheel 20. The distal end of the tow bar 560 attaches to the plurality of hitch assemblies 564 and 565, allowing the system 10 to be towed and maneuvered by a vehicle, such as an all terrain vehicle (ATV), lawn tractor or other tractor, truck, etc. Also depicted in FIG. 5 is an electrical connector 563 that can be used to connect lights and/or any other electrical device to the power system of the tow vehicle or any other power source. Lights, although not shown, could be attached to the rear wheel assembly, vacuum vessel device, etc. and configured in any way currently known in the art.

The first hitch assembly 564 is configured with a ball hitch that attaches to a standard-type trailer ball attached to a tow vehicle. The first hitch assembly 564 can be sized to fit any of the ball sizes used in the industry. The second hitch assembly 565 is configured with a pin hitch that attaches to any trailer hitch requiring a clevis pin type connection. Other trailer/tow-equipment connections are contemplated in other embodiments.

While particular embodiments have been described and disclosed in the present application, it is clear that any number of permutations, modifications, or embodiments may be made without departing from the spirit and the scope of this disclosure.

Particular terminology used when describing certain features or aspects of the embodiments should not be taken to imply that the terminology is being redefined herein to be restricted to any specific characteristics, features, or aspects with which that terminology is associated. In general, the terms used in the following claims should not be construed to be limited to the specific embodiments disclosed in the specification, unless the above Detailed Description section explicitly defines such terms. Accordingly, the actual scope of the claims encompasses not only the disclosed embodiments, but also all equivalent ways of practicing or implementing the claimed subject matter.

The above detailed description of the embodiments is not intended to be exhaustive or to limit the disclosure to the precise embodiment or form disclosed herein or to the particular fields of usage mentioned above. While specific embodiments and examples are described above for illustrative purposes, various equivalent modifications are possible within the scope of the disclosure, as those skilled in the relevant art will recognize. Also, the teachings of the embodiments provided herein can be applied to other systems, not necessarily the system described above. The elements and acts of the various embodiments described above can be combined to provide further embodiments.

Any patents, applications and other references that may be listed in accompanying or subsequent filing papers, are incorporated herein by reference. Aspects of embodiments can be modified, if necessary, to employ the systems, functions, and concepts of the various references to provide yet further embodiments.

In light of the above "Detailed Description," the Inventor may make changes to the disclosure. While the detailed description outlines possible embodiments and discloses the best mode contemplated, no matter how detailed the above appears in text, embodiments may be practiced in a myriad of ways. Thus, implementation details may vary considerably while still being encompassed by the spirit of the embodiments as disclosed by the inventor. As discussed herein, specific terminology used when describing certain features or aspects should not be taken to imply that the terminology is being redefined herein to be restricted to any specific characteristics, features, or aspects of the embodiments with which that terminology is associated.

While certain aspects are presented below in certain claim forms, the inventor contemplates the various aspects in any number of claim forms. Accordingly, the inventor reserves the right to add additional claims after filing the application to pursue such additional claim forms for other aspects.

The above specification, examples and data provide a description of the structure and use of exemplary implementations of the described systems, articles of manufacture and methods. It is important to note that many implementations can be made without departing from the spirit and scope of the invention.

What is claimed is:

1. A vacuum vapor liquid recovery system, comprising:

a vacuum vessel device having a top portion, a bottom portion, and an interior cavity;

a plurality of inflow drain line ports that are adapted to releasably attach to incoming drain lines so as to receive therethrough any last remaining liquids/vapors from equipment;

the vacuum vessel device is adapted to receive vapors and liquids from the plurality of inflow drain line ports and store them in the interior cavity;

an outflow drain line extends from a lowest portion of the interior cavity to a distal end and is adapted to releasably attach to an outgoing drain line so as to output therethrough any last remaining liquids/vapors from the system;

a vacuum relief valve is attached to the vacuum vessel device and is adapted to automatically relieve a vacuum once a vacuum level is reached;

the outflow drain line further comprises a plurality of attachments at the distal end that is adapted to connect to one of a vacuum truck;

the outflow drain line further comprises a shut-off valve that is adapted to be activated when at least a partial vacuum exists in the vacuum vessel device and the shut-off valve will then maintain said vacuum within the system;

the shut-off valve is also adapted such that when the valve is closed, no vapors can escape through the outflow drain line;

a frontal support and repositioning structure is attached to a front portion of the vacuum vessel device and is adapted to support the vacuum vessel device and enhance a user's ability to reposition the system; and a rear support and repositioning structure is attached to a rear portion of the vacuum vessel device and is adapted to support the vacuum vessel device and enhance a user's ability to reposition the system.

2. The vacuum vapor liquid recovery system of claim 1, wherein the frontal support and repositioning structure comprises at least one front wheel and a handle and wherein the at least one front wheel is adapted to maintain the vacuum vessel device at a correct height and orientation so that the lowest portion remains a low point of the vacuum vessel device.

3. The vacuum vapor liquid recovery system of claim 1, wherein the frontal support and repositioning structure comprises a plurality of support legs and a plurality of transport handles and wherein the plurality of support legs is adapted to maintain the vacuum vessel device at a correct height and orientation so that the lowest portion remains a low point of the vacuum vessel device.

4. The vacuum vapor liquid recovery system of claim 1, wherein the rear support and repositioning structure comprises a plurality of rear wheels and wherein the plurality of rear wheels is adapted to maintain the vacuum vessel device at a correct height and orientation so that the lowest portion remains a low point of the vacuum vessel device.

5. The vacuum vapor liquid recovery system of claim 1, wherein the rear support and repositioning structure comprises a plurality of transport handles and a plurality of wheels and wherein the plurality of wheels is adapted to maintain the vacuum vessel device at a correct height and orientation so that the lowest portion remains a low point of the vacuum vessel device.

6. The vacuum vapor liquid recovery system of claim 1, wherein the rear support and repositioning structure comprises a plurality of transport handles and a plurality of support legs and wherein the plurality of support legs is adapted to maintain the vacuum vessel device at a correct height and orientation so that the lowest portion remains a low point of the vacuum vessel device.

7. The vacuum vapor liquid recovery system of claim 2, wherein the handle comprises a pull handle that is adapted to direct the at least one front wheel and allow a user to maneuver and relocate the system.

8. The vacuum vapor liquid recovery system of claim 7, further comprising a handle rest support adapted to provide a structure against which the handle can be rested when not in use.

9. The vacuum vapor liquid recovery system of claim 8, wherein the handle rest support further comprises a handle retention device that includes a grasping clamp which is adapted to receive a portion of the pull handle and securely hold the pull handle in place until swung out therefrom by a user.

10. The vacuum vapor liquid recovery system of claim 3 wherein the plurality of transport handles is adapted such that at least one of a forklift, tractor, and other power equipment can grasp the plurality of transport handles and lift the system.

11. A vacuum vapor liquid recovery system, comprising:

a vacuum vessel device having a top portion, a bottom portion, and an interior cavity;

a plurality of inflow drain line ports that are adapted to releasably attach to incoming drain lines so as to receive therethrough any last remaining liquids/vapors from equipment;

the vacuum vessel device is adapted to receive vapors and liquids from the plurality of inflow drain line ports and store them in the interior cavity;

a sight port is incorporated into the top portion of the vacuum vessel device and is adapted to provide a means for a user to visually inspect the interior cavity of the vacuum vessel device;

an outflow drain line extends from a lowest portion of the interior cavity to a distal end and is adapted to releasably attach to an outgoing drain line so as to output therethrough any last remaining liquids/vapors from the system;

a vacuum relief valve is attached to the vacuum vessel device and is adapted to automatically relieve a vacuum once a vacuum level is reached;

a washout connector is attached to the vacuum vessel device and is adapted to provide for attachment of a washout device to the vacuum vessel device so that at least one of water, chemicals, cleaners, and air can be sprayed into the vacuum vessel device in order to clean out the interior cavity;

the outflow drain line further comprises a plurality of attachments at the distal end that is adapted to connect to one of a vacuum truck;

the outflow drain line further comprises a shut-off valve that is adapted to be activated when at least a partial vacuum exists in the vacuum vessel device and the shut-off valve will then maintain said vacuum within the system;

the shut-off valve is also adapted such that when the valve is closed, no vapors can escape through the outflow drain line;

a frontal support and repositioning structure is attached to a front portion of the vacuum vessel device and is adapted to support the vacuum vessel device and enhance a user's ability to reposition the system; and a rear support and repositioning structure is attached to a rear portion of the vacuum vessel device and is adapted to support the vacuum vessel device and enhance a user's ability to reposition the system.

12. The vacuum vapor liquid recovery system of claim 11, wherein the frontal support and repositioning structure comprises at least one front wheel and a handle and wherein the at least one front wheel is adapted to maintain the vacuum vessel device at a correct height and orientation so that the lowest portion remains a low point of the vacuum vessel device.

13. The vacuum vapor liquid recovery system of claim 11, wherein the frontal support and repositioning structure comprises a plurality of support legs and a plurality of transport handles and wherein the plurality of support legs is adapted to maintain the vacuum vessel device at a correct height and orientation so that the lowest portion remains a low point of the vacuum vessel device.

14. The vacuum vapor liquid recovery system of claim 11, wherein the rear support and repositioning structure comprises a plurality of rear wheels and wherein the plurality of rear wheels is adapted to maintain the vacuum vessel device at a correct height and orientation so that the lowest portion remains a low point of the vacuum vessel device.

15. The vacuum vapor liquid recovery system of claim 11, wherein the rear support and repositioning structure comprises a plurality of transport handles and a plurality of wheels and wherein the plurality of wheels is adapted to maintain the vacuum vessel device at a correct height and orientation so that the lowest portion remains a low point of the vacuum vessel device.

16. The vacuum vapor liquid recovery system of claim 11, wherein the rear support and repositioning structure comprises a plurality of transport handles and a plurality of support legs and wherein the plurality of support legs is adapted to maintain the vacuum vessel device at a correct height and orientation so that the lowest portion remains a low point of the vacuum vessel device.

17. The vacuum vapor liquid recovery system of claim 12, wherein the handle comprises a pull handle that is adapted to direct the at least one front wheel and allow a user to maneuver and relocate the system.

18. The vacuum vapor liquid recovery system of claim 17, further comprising a handle rest support adapted to provide a structure against which the handle can be rested when not in use.

19. The vacuum vapor liquid recovery system of claim 18, wherein the handle rest support further comprises a handle retention device that includes a grasping clamp which is adapted to receive a portion of the pull handle and securely hold the pull handle in place until swung out therefrom by a user.

20. The vacuum vapor liquid recovery system of claim 13 wherein the plurality of transport handles is adapted such that at least one of a forklift, tractor, and other power equipment can grasp the plurality of transport handles and lift the system.

* * * * *